US005625898A

United States Patent [19]

Telega

[11] Patent Number: 5,625,898

[45] Date of Patent: May 6, 1997

[54] COMBINED INNER AND OUTER GARMENT

[76] Inventor: Brian J. Telega, 3981 El Camino Rd. South, Las Vegas, Nev. 89103

[21] Appl. No.: 557,747

[22] Filed: Nov. 13, 1995

[51] Int. Cl.[6] ..... A41D 1/06

[52] U.S. Cl. ..... 2/79; 2/78.2

[58] Field of Search ..... 2/79, 70, 71, 72, 2/73, 75, 77, 78.1, 78.2, 115, 114, 80, 69

[56] References Cited

U.S. PATENT DOCUMENTS

| | | | |
|---|---|---|---|
| 1,186,866 | 6/1916 | Van Heusen | 2/78.2 |
| 1,424,388 | 8/1922 | Winderman et al. | 2/79 |
| 1,814,457 | 7/1931 | Spiers | 2/77 |
| 2,132,610 | 10/1938 | Ellinger . | |
| 3,840,900 | 10/1974 | Cruz . | |
| 5,033,121 | 7/1991 | Larsen . | |
| 5,081,716 | 1/1992 | Lehenbauer . | |

*Primary Examiner*—C. D. Crowder
*Assistant Examiner*—Gloria Hale
*Attorney, Agent, or Firm*—Joseph N. Breaux

[57] ABSTRACT

A combination inner and outer dress-type shirt garment including an outer wear portion having a dress collar, a back center line and a button down front including a left button hole edge and a right button edge; and an inner wear portion comprising a substantially rectangular right leg section and a substantially rectangular left leg section. The rectangular right leg section is securable with the snap fasteners to form a right tubular leg for receiving the right leg of a wearer. The rectangular left leg section is securable with the snap fasteners to form a left tubular leg for receiving the left leg of a wearer.

1 Claim, 3 Drawing Sheets

COMBINED INNER AND OUTER GARMENT

TECHNICAL FIELD

The present invention relates to garments and more particularly to garments worn simultaneously as both inner and outer wear garments.

BACKGROUND ART

Maintaining a tailored appearance is difficult for those individuals who have trouble maintaining the tail portion of a dress-type shirt tucked neatly withing his pants or slacks. It would be a benefit, therefore, to have a dress-type shirt that included a retaining mechanism that maintained the tail portions of the dress shirt within the pants or slacks of a wearer. It would be a further benefit if the retaining mechanism allowed the user to utilize the tail portion of a dress shirt as an underwear garment to avoid excess undergarment lines showing through the slacks or pants.

GENERAL SUMMARY DISCUSSION OF INVENTION

It is thus an object of the invention to provide a dress-type shirt that includes an outer wear portion that appears as a conventional dress-type shirt in combination with an inner wear garment that includes a retaining mechanism for maintaining the tail portions of the dress shirt within the pants or slacks of a wearer.

It is a further object of the invention to provide a dress-type shirt having a shirt tail retaining mechanism that allows the user to utilize the tail portion of the dress shirt as an article of underwear.

Accordingly, a combination inner and outer dress-type shirt garment is provided. The combined shirt garment includes an outer wear portion having a dress collar, a back center line and a button down front including a left button hole edge and a right button edge; and an inner wear portion comprising a substantially rectangular right leg section and a substantially rectangular left leg section, the right leg section having a right front side edge oriented in alignment with the right button edge and a right rear side edge substantially oriented along a line extending from the back center line of the outer wear portion, the left leg section having a left front side edge oriented in alignment with the left button hole edge and a left rear side edge substantially oriented along the same center line as the right rear side edge. The phrase "oriented in alignment" is used herein to mean oriented in a manner such that the one edge or line points to or touches the aligned edge. The right front side edge and right rear side edge have at least four pairs of interlocking snap fasteners secured thereon in a manner such that the right front side edge and the right rear side edge are securable with the snap fasteners to form a right tubular leg for receiving the right leg off a wearer. The left front side edge and left rear slide edge have at least four pairs of interlocking snap fasteners secured thereon in a manner such that the left front side edge and the left rear side edge are securable with the snap fasteners to form a left tubular leg for receiving the left leg of a wearer.

The inner portion is preferably constructed from an underwear type fabric such as a knit or woven cotton fabric.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
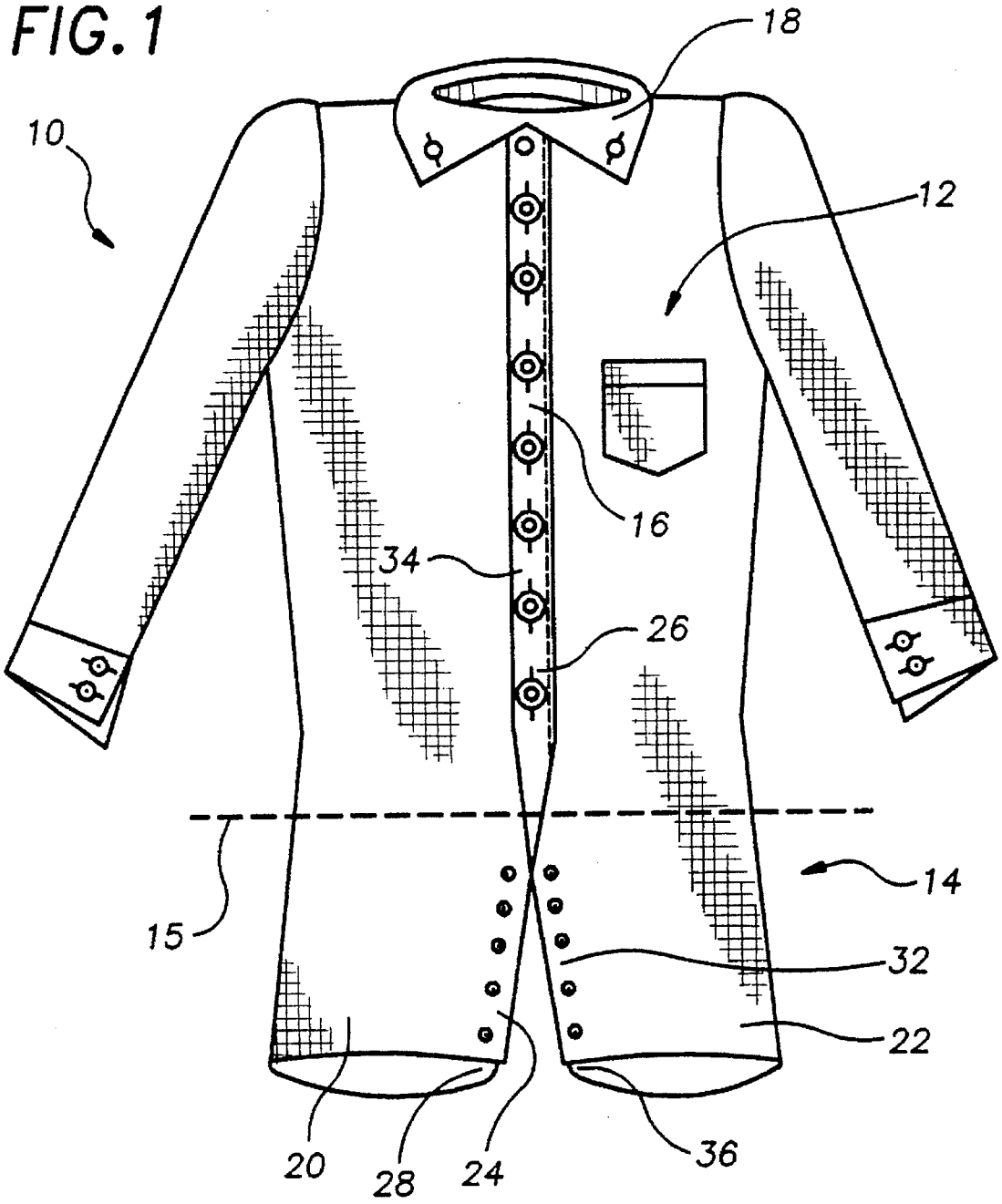
FIG. 1 is a front view of an exemplary embodiment of the combined inner and outer wear dress-type shirt garment of the present invention showing the button down front, the collar and the left and right leg sections configured in the tubular leg configuration.

FIG. 1 is a front view showing an exemplary embodiment of the combined inner and outer wear dress-type shirt garment of the present invention generally designated by the numeral 10. Shirt garment 10 includes an outer wear portion, generally designated by the numeral 12, and an inner wear portion, generally designated by the numeral 14, that are integrally formed. For illustration purposes the division between the inner wear portion 14 and the outer wear portion 12 is generally depicted by a dashed line 15.

Outer wear portion 12 has the general appearance and construction of a conventional dress-type shirt including a button down front 16 and a collar 18. Although in this embodiment outer wear portion 12 and inner wear portion are integrally formed from cotton broadcloth, it is considered by the inventor hereof that embodiments utilizing different construction materials for each portion are within the scope of the invention taught herein. When different materials are used, they may be stitched or otherwise joined together.

Figure 2:
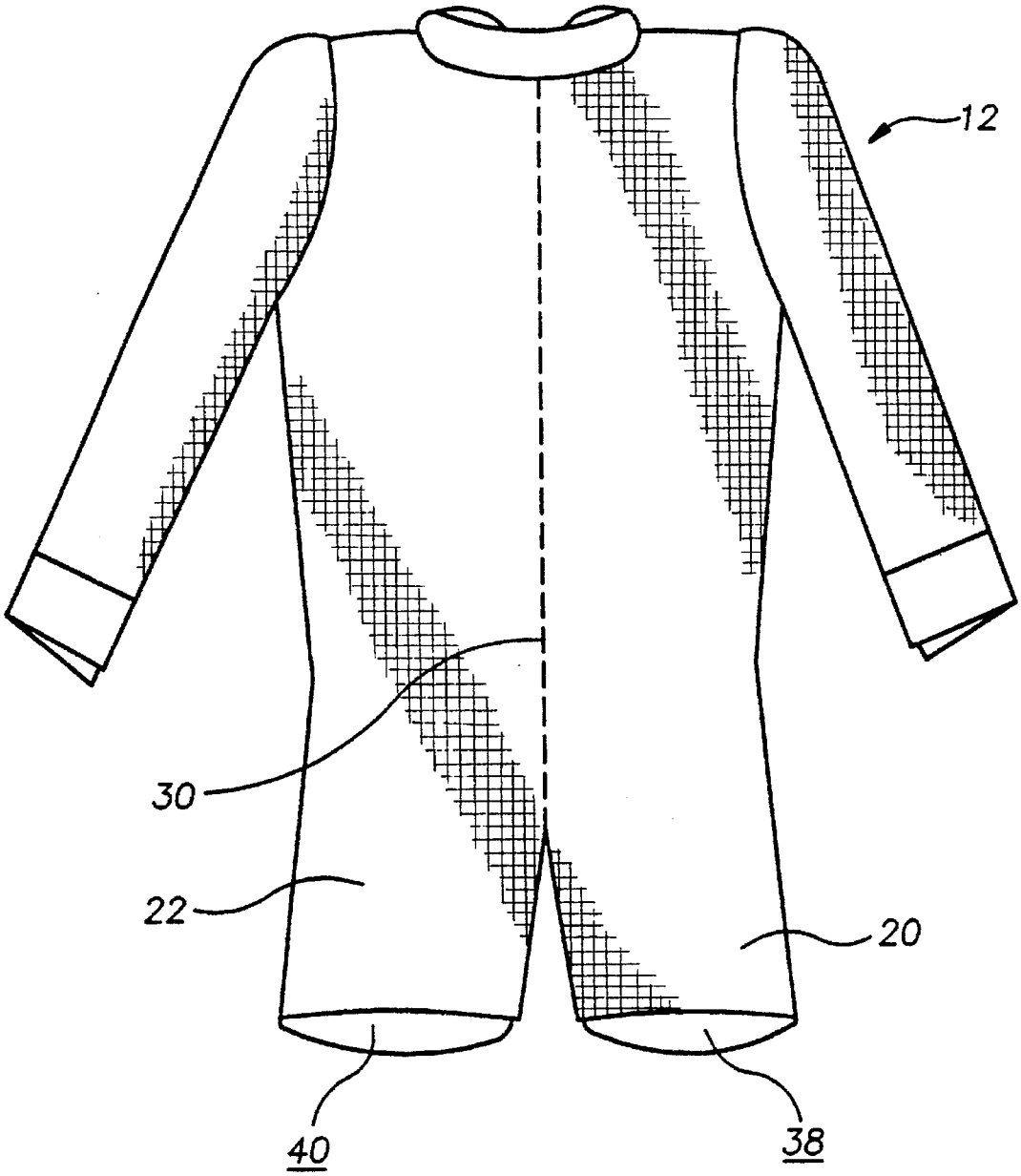
FIG. 2 is a back view of the combined shirt garment of FIG. 1 showing the back center line (indicated with a dashed line), the collar, and the left and right leg sections configured in the tubular leg configuration.

Inner wear portion 14 comprises a substantially rectangular right leg section 20 and a substantially rectangular left leg section 22. Right leg section 20 has a right front side edge 24 oriented in alignment with a right button edge 26 and a right rear side edge 28 substantially oriented along a line extending from the back center line 30 (shown in FIG. 2) of outer wear portion 12. Left leg section 22 has a left front side edge 32 oriented in alignment with a left button hole edge 34 and a right rear side edge 36 substantially oriented along back center line 30 (shown in FIG. 2). With reference to FIG. 2, leg sections 20,22 are configureable in a tube shaped leg configuration to form a right leg opening 38 and a left leg opening 40.

Figure 3:
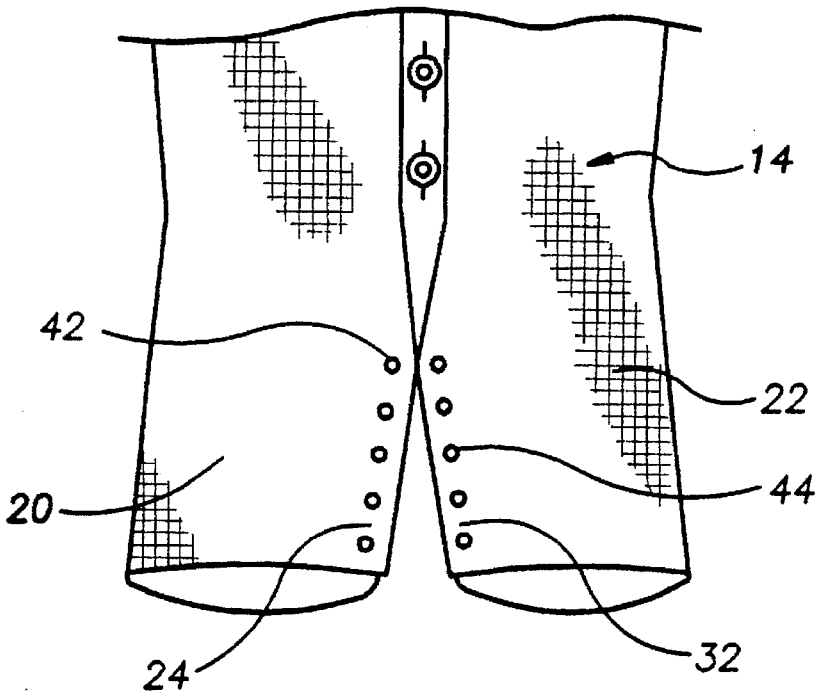
FIG. 3 is a detail view off the front edges of the left and right leg sections with the snap fasteners unfastened.
Figure 4:
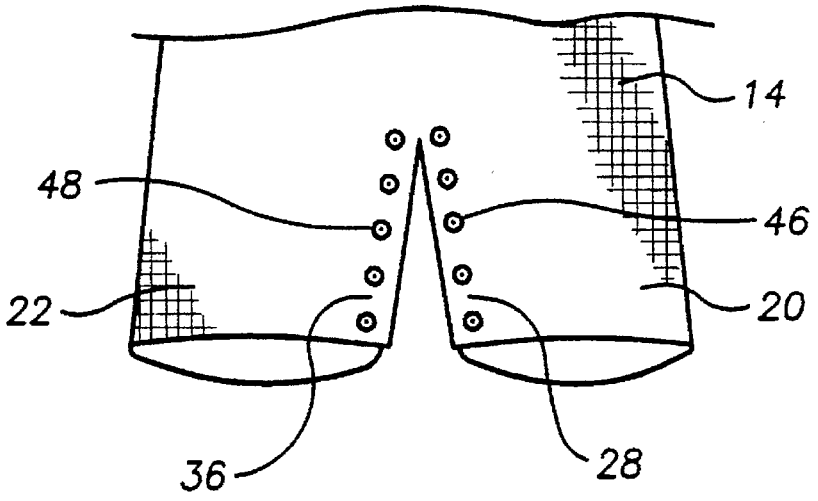
FIG. 4 is a detail view of the rear edges of the left and right leg sections with the snap fasteners unfastened.

FIG. 3 is a front detail view of inner wear portion 14 with left and right leg sections 20,22 in the open configuration. As shown in the figure, right front side edge 24 has the five male portions 42 of five right leg pairs of interlocking snap fasteners secured thereon. Left front side edge 32 as similarly outfitted with the five male portions 44 of five left leg pairs of interlocking snap fasteners. FIG. 4 is a back detail view of inner wear portion 14 with left and right leg sections 20,22 in the open configuration. As shown in the figure, right back side edge 28 has the five female portions 46 of the five right leg pairs of interlocking snap fasteners secured thereon. Left back side edge 36 is similarly outfitted with the five female portions 48 of the five left leg pairs of interlocking snap fasteners.

Use and donning of shirt garment 10 is now described with general reference to FIGS. 1–4. The wearer first confirms that button down front 16, collar 18, the five male and female portions 42,46 of the five right leg pairs of interlocking snap fasteners, and the five male and female portions 44,48 of the five left leg pairs of interlocking snap fasteners are all unfastened. The wearer dons shirt garment 10 in the conventional fashion and secures button down front 16 and collar 18, also in the conventional fashion. Inner wear portion 14 is then secured about the left and right legs of the user by securing front and rear right side edges 24,28 of right leg section 20 together with the five male and female portions 42,46 with the right leg of the wearer extending outwardly from right leg opening 38. The front and rear left side edges 32,36 of left leg section 22 are then secured together with the five male and female portions 44,48 with the left leg of the wearer extending outwardly from left leg opening 40. With inner wear portion 14 thus configured about the legs of the wearer, a pair of pants or slacks may be donned in the conventional fashion without additional underwear, such as briefs or boxer shorts, and without having to worry about shirt garment 10 becoming untucked from the slacks or pants.

It can be seen from the preceding description a dress-type shirt has been provided that includes an outer wear portion that appears as a conventional dress-type shirt in combination with an inner wear garment that includes a retaining mechanism for maintaining the tail portions of the dress shirt within the pants or slacks of a wearer and that has a shirt tail retaining mechanism that allows the user to utilize the tail portion of the dress shirt as an article of underwear.

It is noted that the embodiment of the combined inner and outer garment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combined inner and outer garment comprising:

an outer wear portion constructed from cotton broadcloth having a button down dress collar, a back center line and a button down front including a left button hole edge and a right button edge; and an inner wear portion integrally formed with said outer wear portion comprising a substantially rectangular right leg section and a substantially rectangular left leg section;

said right leg section having a right front side edge oriented in alignment with said right button edge and a right rear side edge substantially oriented along a line extending from said back center line of said outer wear portion, said left leg section having a left front side edge oriented in alignment with said left button hole edge and a left rear side edge substantially oriented along said same line as said right rear side edge, said right front side edge and said right rear side edge having at least four pairs of interlocking snap fasteners secured thereon in a manner such that said right front side edge and said right rear side edge are securable with said snap fasteners to form a right tubular leg for receiving a right leg of a wearer, said left front side edge and said left rear side edge having at least four pairs of interlocking snap fasteners secured thereon in a manner such that said left front side edge and said left rear side edge are securable with said snap fasteners to form a left tubular leg for receiving a left leg of a wearer.

* * * * *